US005164151A

United States Patent [19]

Shah et al.

[11] Patent Number: 5,164,151

[45] Date of Patent: Nov. 17, 1992

[54] MANIPULATOR SYSTEM FOR AN ENCLOSURE WITH A LIMITED ACCESS POINT

[76] Inventors: Jagdish H. Shah, 41 Abrams Rd., Cheshire, Conn. 06410; Cliff Evans, 12 Ashford La., Newtown, Conn. 06470; Donald D. Stenabaugh, 248A Oakville Ave., Waterbury, Conn. 06708

[21] Appl. No.: 719,442

[22] Filed: Jun. 24, 1991

[51] Int. Cl.[5] ..... G21C 19/00

[52] U.S. Cl. ..... 376/260; 165/11.2; 901/8

[58] Field of Search ..... 376/260, 249, 204; 165/11.2, 76; 901/1, 8, 15, 16, 41, 44; 414/4; 29/890.031, 428, 723, 726

[56] References Cited

U.S. PATENT DOCUMENTS 4,168,782 9/1979 Sturges, Jr. ..... 414/4
4,179,035 12/1979 Francois et al. ..... 414/2
4,561,816 12/1985 Dingess ..... 165/11.2
4,672,741 6/1987 Zafred ..... 376/249
4,919,194 4/1990 Gery et al. ..... 165/1
4,954,192 9/1990 Trundle et al. ..... 376/260
4,954,312 9/1990 McDonald et al. ..... 376/260
4,957,215 9/1990 Evans et al. ..... 220/232

*Primary Examiner*—Daniel D. Wasil
*Attorney, Agent, or Firm*—Robert A. Seemann

[57] ABSTRACT

In an enclosure of a heat exchanger that includes a wall having an opening for access to the enclosure and a nozzle for fluid flow through the wall, an articulate hoist for bringing an articulate manipulator into the enclosure is attached to the wall outside the opening. The lifting portion of the hoist, which is in the enclosure brings the manipulator into the enclosure. The manipulator which is is then attached to the wall outside the opening is adapted for reaching through the opening from inside the enclosure. A tool operator portion of the manipulator is adapted for engaging a nozzle dam for inserting the dam in the nozzle. One type of nozzle dam which the apparatus can install is one that falls within the description of a claim of U.S. Pat. No. 4,957,215.

16 Claims, 6 Drawing Sheets

MANIPULATOR SYSTEM FOR AN ENCLOSURE WITH A LIMITED ACCESS POINT

BACKGROUND OF THE INVENTION

1. Field of the Invention

The present invention pertains to installation and utilization of a remotely operated manipulator system in a confined enclosure, by way of a relatively small port. It includes installation of the system in a radioactive, confined enclosure, and installation of a nozzle dam in a nozzle of the enclosure by the system without need for an operator in the enclosure.

2. Description of the Prior Art

A variety of apparatus and methods are taught for performing work in an enclosure that is confined or that presents an unsafe environment such as in a heat exchanger water box, whereby the operator can conduct the operation from outside the enclosure.

One such environment includes both hazards for an operator. It is within the heat exchanger portion of a nuclear reactor boiler. The present invention will be described with respect to that most demanding application, although it should be understood that application of the present invention includes other areas such as performing work behind any wall having an access port.

A nuclear reactor boiler heats water for steam by transferring heat from radioactive reactor water, through heat exchanger tubes, to nonradioactive water.

The boiler receives the super heated radioactive water from the core of the reactor by way of an inlet port or "inlet nozzle" into a typically five foot high first sealed cavity occupying about one half of the rounded bottom of the boiler. The water is drawn upward through parallel, vertical heat exchanger tubes within the boiler which begin from openings in the roof of the cavity. The tubes extend within the boiler to the top of the boiler and then turn downward to open into the roof of a second sealed cavity which shares a partition with the first cavity at the bottom of the boiler. The water is drawn from the second cavity by way of an outlet port or "outlet nozzle" by means of an external pump. The roof comprising the open ends of the tubes is sometimes called a "tube sheet".

The radioactive first and second cavities and tubes must be emptied of radioactive water for periodic cleaning which may include inspection and repair.

Regarding the first cavity, the input port must be sealed for safety by a nozzle dam such as the SEGMENTED NOZZLE DAM described in U.S. Pat. No. 4,957,215 patented by Evans et al. on Sep. 18, 1990. This holds back the reactor water to permit safe occupation of the first cavity by an operator in protective garb. It also permits cleaning elements of the cavity without having to lower water in the reactor core in order to keep water out of the first cavity.

Regarding the second cavity, the output port must also be sealed because a static water head is above both cavities at certain times. The second cavity must also be accessed for cleaning and servicing.

A limited access, circular, shoulder-wide approximately 16" diameter standardized port called a "manway" is provided in the wall of each cavity 90 degrees around from the applicable inlet or outlet port so that an operator can enter the cavity to install the dam and participate in the cleaning operation. Permissible maximum time for any one operator in the cramped radioactive environment of the boiler cavity is limited to only minutes per year, as determined by the radiation exposures commonly found in such boiler cavities.

When used in this demanding application, the present invention reduces the man minute and therefore man-REM exposure in the radioactive boiler needed for a cleaning or servicing operation. It also eliminates personal safety problems in the slippery, environmentally hot (radioactive) cavity where accidents have been known to have occurred in the past.

U.S. Pat. No. 4,168,782, patented by Sturges, Jr. Sep. 25, 1979 describes a remote access manipulator for limited access areas such for working on a tube sheet within a primary outlet plenum of a nuclear steam generator.

A slave carriage and manipulator arm for accessing the plenum are operated by duplicating in them, the motion of a miniaturized model that is moved by the operator.

The manipulator arm moves in and out of the manway entrance to the plenum by traveling on a track that passes through the manway. The track is attached near one end to the outside of the manway. It passes through the manway, and leans away from the manway within the plenum where it is supported against the plenum inner wall by an adjustable foot.

The arm includes a base that moves on cam rollers which are disposed in the track and moved by a chain.

The carriage includes cam locks which may be inserted in tube holes in the tube sheet, whereby the carriage is able to traverse the tube sheet in an unlimited number of directions by repeated repositioning and locking into the tube sheet while rotating upon one of the cam locks.

During installation, the track is introduced through the manway and bolted into place. The arm is then assembled with a first end of the arm on the portion of the track that extends out of the steam generator. Next, the arm is cranked into the steam generator along the track by means of a chain, with the second end of the arm extending back out through the manway.

The carriage is then attached to the second end of the arm, and taken into the plenum by the arm and positioned against the tube sheet for attaching the carriage to the tube sheet by the cam. The arm is then operated to disconnect from the attached carriage, and reach back through the manway to take tools for installing in a tool operating location in the carriage for work on the tubes.

U.S. Pat. No. 4,179,035, patented Dec. 18, 1979 by Francois et al., describes a master-slave manipulator for performing work in an enclosure such as a water box of a heat exchanger for a pressurized-water reactor.

The master and slave portions of the manipulator are counterbalanced from a connecting shaft and operatively connected by pulleys and chains over rotatable joints. The slave portion of the manipulator is operated by manipulating the master portion by hand.

The manipulator is supported by the connecting shaft which is rotatably mounted through the center of a plate designed for mounting over an opening in the wall of the enclosure. The plate includes trunnions for supporting it during transport.

To install the manipulator in the enclosure for work therein, the manipulator assembly is carried at the trunnions by a jack-operated supporting arm of a dolly that is used to position the plate over the opening. The positioned plate covers the opening, with the slave portion of the manipulator extending into the enclosure.

Holes are provided through the plate for the introduction of inspection equipment such as an endoscope, lamp or television camera, to the interior of the enclosure.

U.S. Pat. No. 4,919,194, patented Apr. 24, 1990 by Gery et al. describes a method for installing a robot arm in an operating zone within a containment vessel that includes an access opening, such as in a steam generator of a pressurized-water nuclear power station.

The robot arm includes at its first end, a compass arrangement consisting of two hinged-together arms with a foot plate at the second end. The foot plate is attached to a carriage or dolly by which the folded robot may be moved into position under the vessel.

Once in position under the vessel, the second end of the robot arm attaches to a first support point having known coordinates with respect to the opening of the vessel such as an attachment bracket mounted on the floor of the room. The foot plate at the first end then detaches from the carriage and moves to a second support point of known coordinates that is adjacent to the opening, where the foot plate is then affixed. The second end of the robot then detaches from the bracket, and is free to receive tools and enter the access opening for working in the operating zone with reference to coordinates of the second support point.

U.S. Pat. No. 4,954,312 patented by McDonald et al. on Sep. 4, 1990, describes a method for remotely installing a dam unit in a nozzle of a nuclear steam generator head, by use of a manipulator arm which has a clamp or jaw member. The method includes passing the manipulator through a manway in the wall of the head and attaching the manipulator by a mounting pedestal to a head internal surface such as the inward facing surface of the wall, or to a plurality of tube ends in the tube sheet that is in the enclosure.

Once the manipulator is secured to the tube sheet, it is fed segments of the dam unit by way of the manway, each segment being dovetailed to fit with the previous segment to build the dam unit. The segments are each fed to the manipulator by sliding a successive one on the last one, and fastening lock bolts. The assembled dam unit is then moved within the head by the manipulator, to the nozzle and positioned there for sealing the nozzle. Hold down bars are then attached to the head to help support the dam against hydraulic load.

U.S. Pat. No. 4,959,192 patented by Trundle et al. on Sep. 25, 1990 describes a system for moving a nozzle dam into the head of a nuclear reactor steam generator, locating it over the nozzle, and bolting it down.

In this system, a rod with appropriate tooling is extended through the manway to attach a pulley to the tube sheet over the nozzle. A rope which runs over the pulley and which has its first end outside the manway is attached by its second end to strapping means which holds the nozzle dam in a folded condition.

With help of the rope, the pulley, and a hook pole, the nozzle dam is taken into the head, unfolded and positioned over the nozzle. It is bolted down by a torquing tool and a torquing machine that is similarly brought in by the rope and pulley, wherein the pulley may be temporarily attached to the tube sheet over the manway if desired.

SUMMARY OF THE INVENTION

It is one object of the invention to provide a manipulator system for an enclosure with a limited access port in which the manipulator elements may be installed in the enclosure for work in the enclosure without need for an operator entering the port.

It is another object to provide a manipulator system for an enclosure with a limited access port in which the system can be used to operate on an item in the enclosure without need for the system being attached to a coordinate reference point within the enclosure.

It is yet another object to provide the manipulator system wherein the system can operate on an item in the enclosure without need for the system being attached to a coordinate reference point outside of the enclosure.

It is another object to provide a manipulator system for an enclosure with a limited access port in which the manipulator system comprises two independent articulate (or jointed) elements which may cooperate to perform a task within the enclosure.

It is yet another object to provide a manipulator system for an enclosure with a limited access port in which the system can be used to install a nozzle dam in the enclosure without need for the system being attached to a coordinate reference within or outside of the enclosure.

Another object is to provide a manipulator system comprising a number of the above attributes, which may be used to install a nozzle dam of the type described in U.S. Pat. No. 4,957,215, patented by Evans et al. on Sep. 18, 1990.

Other objects and advantages of the present invention will become obvious to one skilled in the art, from the ensuing description.

In an enclosure of a heat exchanger which includes a nozzle for fluid flow through a wall of the enclosure, articulate means for hoisting for bringing articulate manipulator means into the enclosure, includes a first mounting base attached to a wall of the enclosure at an opening provided in the wall for access to the enclosure. The means for hoisting includes a lifting portion that is in the enclosure.

Articulate manipulator means which includes a second mounting base and a tool operator portion is attached to the wall, at the opening, by the second base. The tool operator portion is in the enclosure.

The attachment of the second mounting base to the wall includes attachment means outside the enclosure, the manipulator means being adapted for reaching through the opening from inside the enclosure when the second mounting base is attached to the enclosure.

The tool operator portion of the manipulator means is adapted for engaging nozzle dam means for inserting the nozzle dam means in the nozzle.

One type of nozzle dam which the present invention can install comprises one that falls within the description of a claim of U.S. Pat. No. 4,957,215.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
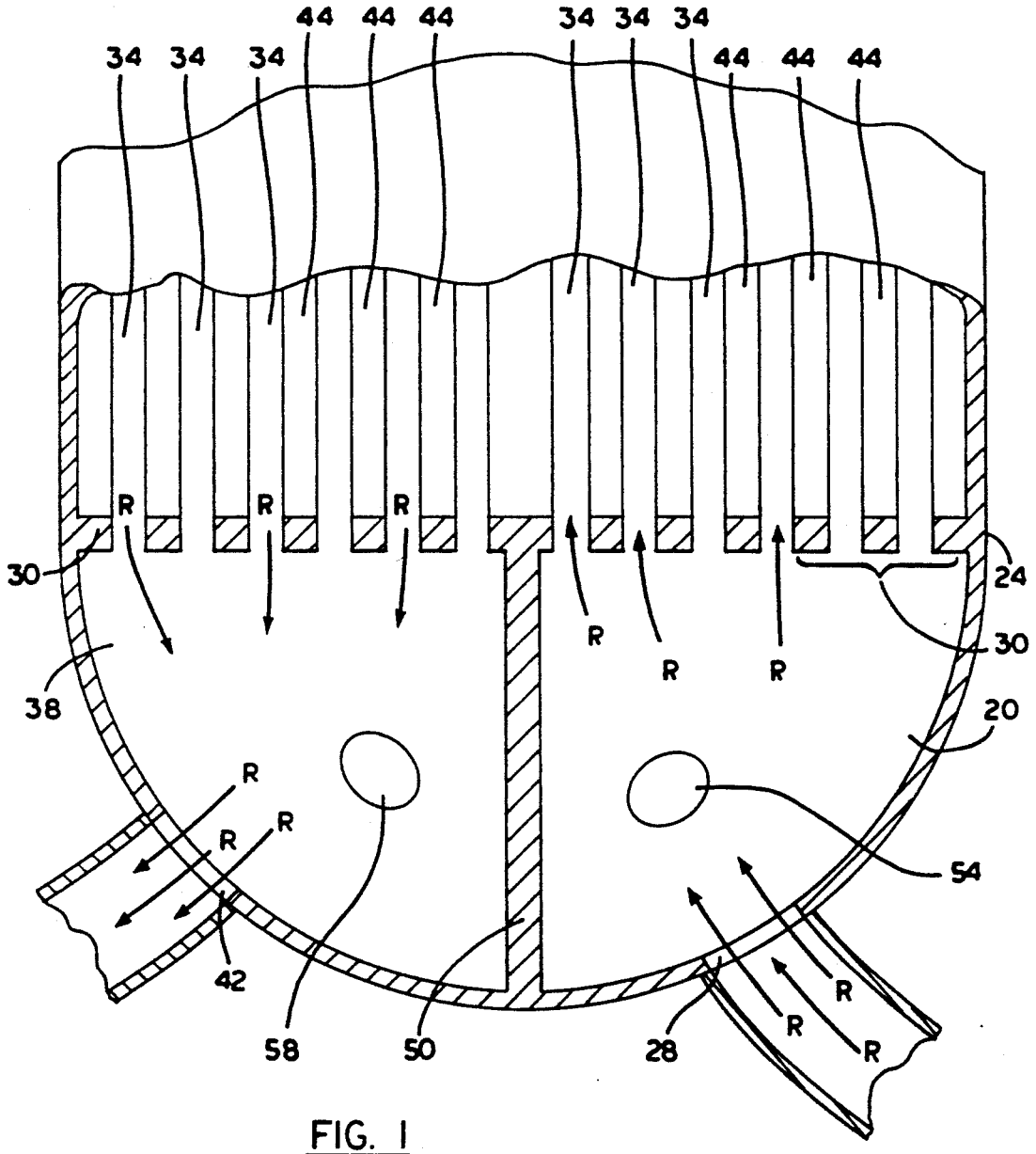
FIG. 1 is a schematic view of a nuclear reactor heat exchanger boiler plenum enclosure.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to the drawings, the invention will be described now with reference to the enclosure of a nuclear reactor heat exchanger similar to the one shown in FIG. 1.

Enclosure 20 of nuclear reactor heat exchanger 24 receives radioactive reactor water by way of nozzle 28. The water flows in the direction of arrows "R", through the face of tube sheet 30, and within reactor water tubes 34, to return through the tube sheet 30 into enclosure 38, and out to a pump and to the reactor by way of nozzle 42. Secondary water for steam generated by transfer of heat from reactor water tubes 34, runs through secondary water tubes 44.

Enclosures 20 and 38, which are separated by partition 50, are accessed respectively for work within the enclosures by manways 54 and 58. The manway diameter is smaller than the nozzle diameter.

Figure 2:
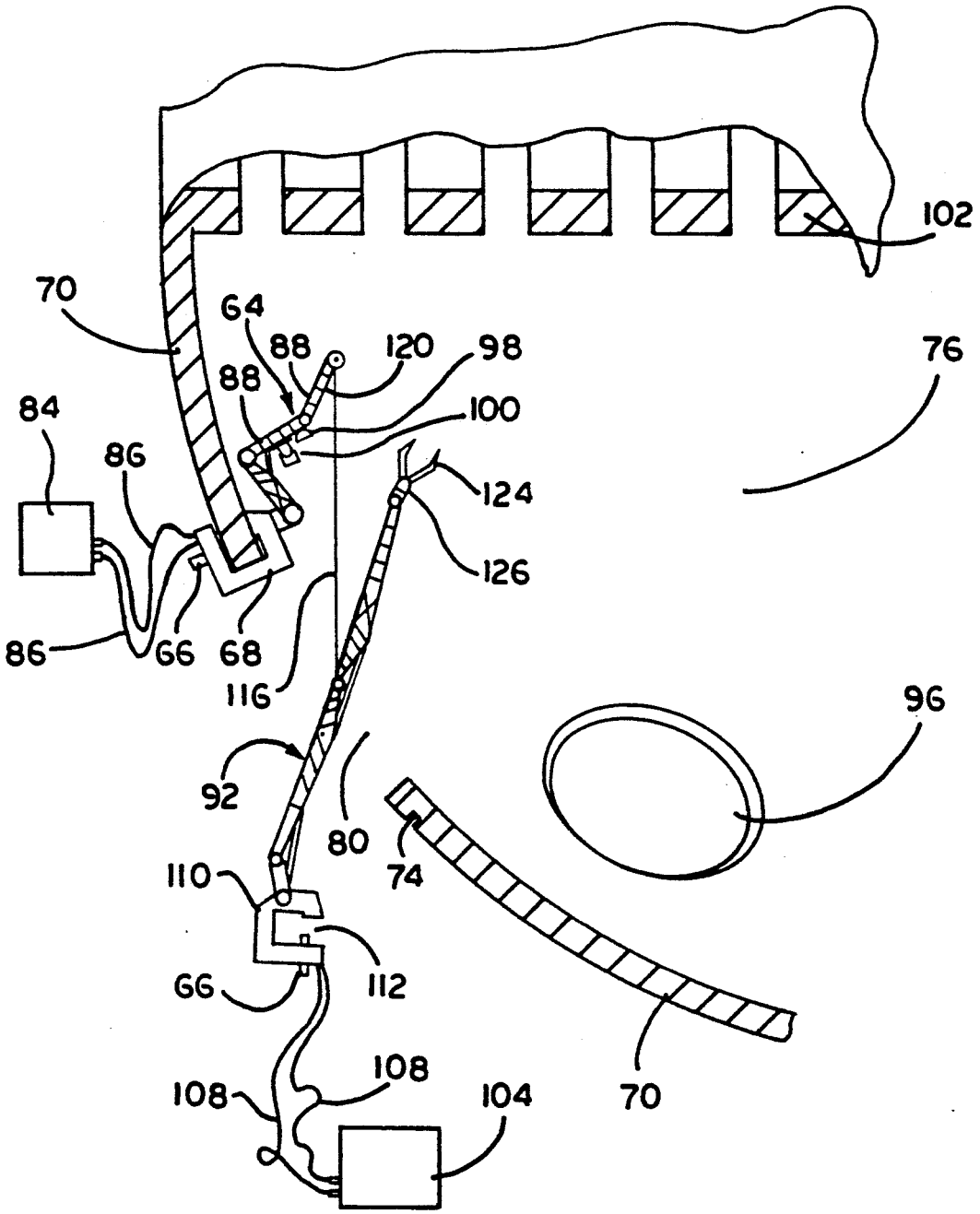
FIG. 2 is a schematic view of one element of the system installed in a nuclear reactor heat exchanger enclosure, bringing in another element of the system according to the present invention.

Referring to FIG. 2, hoist 64 is attached by bolts 66 to wall 70 on the outside of enclosure 76, adjacent to manway 80. Mounting base 68 is U shaped to provide maximum clearance for the opening of manway 80. Hoist 64 is operated by remote control box 84, via connectors 86.

Hoist 64, which includes two articulated segments 88 is adapted to draw manipulator 92 into enclosure 76 for work related to nozzle 96. Motor directed work light 98, and motor directed television camera 100 on hoist 64, help in observing the work within the enclosure.

Enclosure 76 is bounded by wall 70, tube sheet 102, and a partition (not shown) which is similar to partition 50 of heat exchanger 24 shown in FIG. 1.

Manipulator 92 is operated by remote control box 104 via connectors 108. Manipulator 92 includes preferably five articulations.

One manipulator suitable for this application is the Gamma 7F made by Schilling Development of Davis, CA. The spatially correspondent manipulator with seven functions, a lift capacity at full extension of 250 pounds, with maximum reach of 78 inches, responds to movement of, and finger grip on, a knob of a 10"×6"×12" master console.

When mounting base 110 of manipulator 92 is brought into line with wall 70, it is slipped on and fastened to the outside of wall 70 by bolts 66 in bolt holes 74. The bolt holes are shown in cutaway of wall 70.

In order to align base 110 with the wall for bolting in place, hoist 64 lifts manipulator 92 until slot 112 of base 110 is in line with the edge of wall 70, then base 110 is urged onto the wall by force brought to bear upon preferably a portion of the manipulator that is outside the enclosure.

Need for the outside urging force can be dispensed with, however, by drawing the manipulator by cable 116 to arm assembly 120 until a jaw assembly 124 of tool operator 126 can grip arm assembly 120. The manipulator is then made to grip arm assembly 120, thereby obtaining a fulcrum point for using the manipulator to move its own mounting base into place on wall 70.

Figure 3:
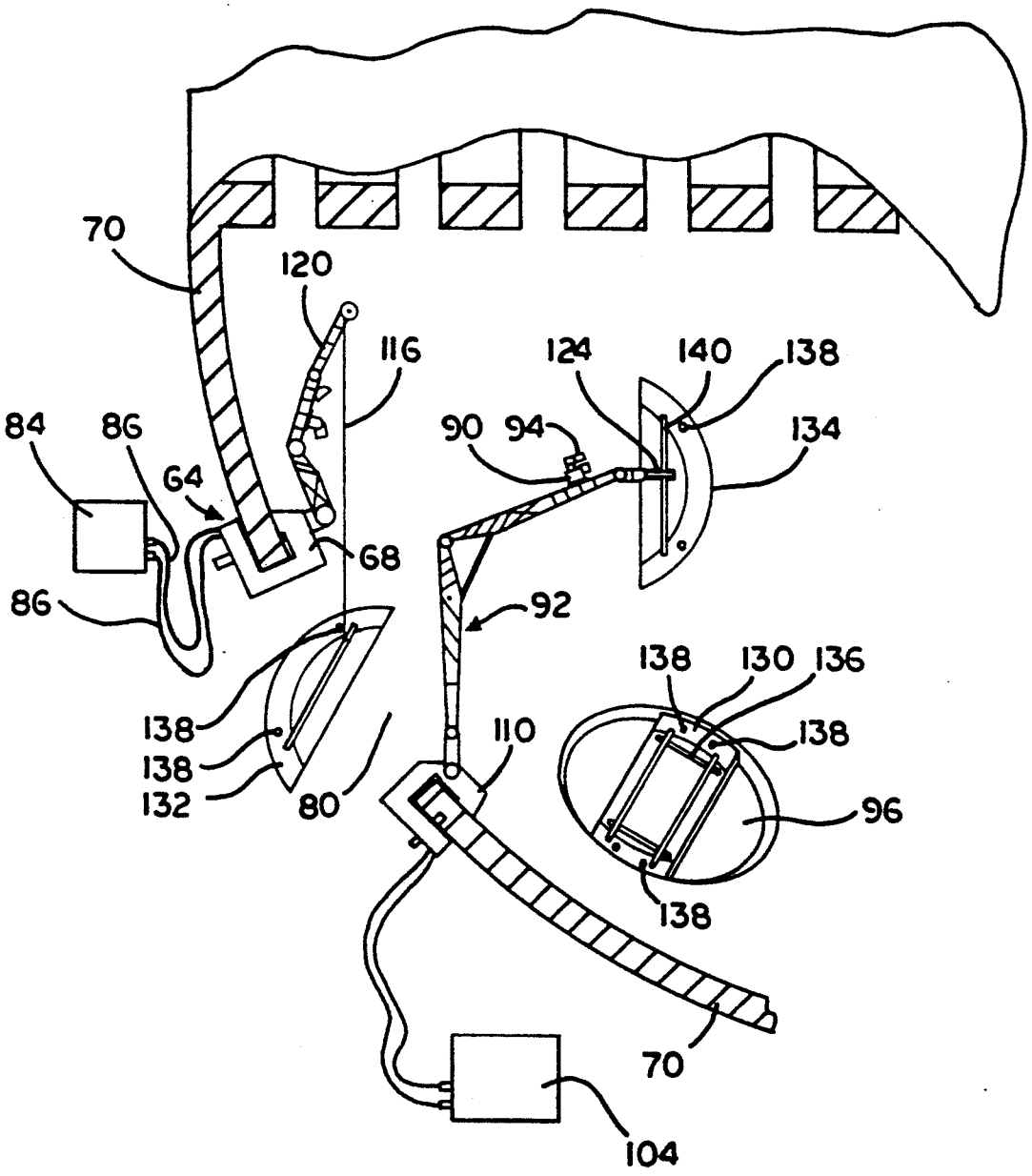
FIG. 3 is a schematic view of the system installed in the enclosure of FIG. 2, handling a nozzle dam for installation in the enclosure.

FIG. 3 shows both hoist 64 and manipulator 92 mounted on wall 70, working together to install a nozzle dam of the type which is described in U.S. Pat. No. 4,957,215 which is hereby incorporated by reference. Although it should be readily apparent the present invention is capable of installing most of the nozzle dam designs presently available, the one described in U.S. Pat. No. 4,957,215 is well suited for installation by this system. This is because of the easy access it provides for the manipulator for holding, positioning, and trouble-free fastening by means of the dam's integral beams and bolts with removable knob, thread pairs of different pitch, and wrench flats for removal of bound threads.

The nozzle dam is assembled from three sections, a central section 130, and left and right sections 132 and 134 respectively.

In FIG. 3, as it is shown, manipulator 92 with the aid of remote controlled camera 90 and remote controlled light 94, has placed section 130 in nozzle 96, and is grasping section 134 by beam 140 as it orients section 134 for installing it in the nozzle to the right of section 130. Section 130 which is heaver includes a pair of grasping bars 136 mounted on a pair of beams 140. Section 130 is held by grasping bars 136 when it is installed. Section 130 includes a rubber seal and an expandable seal ring (not shown). It is within the capability of the present invention to install the ring in stages with the nozzle sections.

Section 132 is then carried up through manway 80 by cable 116 of hoist 64, and held in the enclosure for pick up and installing by manipulator 92. The manipulator then screws each fastener assembly 138 down to hold the nozzle dam in place in the nozzle. Beams 140 are an integral part of the dam for strengthening the dam against hydraulic load without their being attached to the nozzle.

Although hoist 64 may be used to install manipulator 92, and is preferably used to remove manipulator 92, the hoist need not necessarily be required for work in the enclosure.

Figure 4:
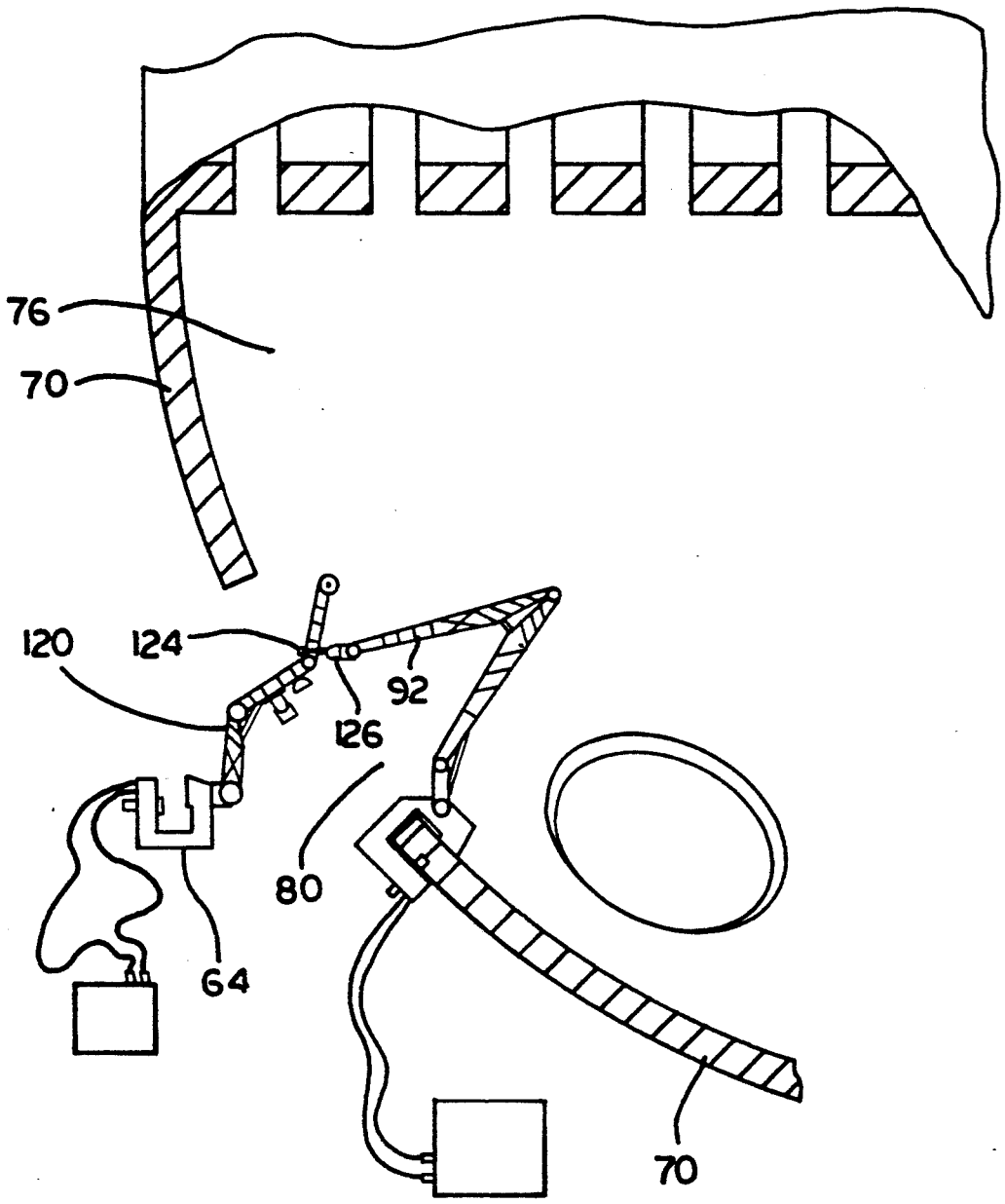
FIG. 4 is a schematic view of one element of the system removing another element of the system from the enclosure of FIG. 2.

FIG. 4 shows manipulator 92 handing hoist 64 out through manway 80. Hoist is unbolted after it is securely grasped by jaw assembly 124 of tool operator 126 of the manipulator.

Although in FIGS. 2 and 3, hoist 64 is shown using a cable in lifting items into the enclosure, it is within the contemplation of the invention that the lifting be done by an articulated segment of the hoist without an intervening cable.

The manipulator system is positioned with precision for work in the enclosure by taking reference from cameras, borescopes and the like which are preferably mounted on the manipulator, without need for preliminary attachment of the manipulator to a reference point on or in the enclosure.

Figure 5:
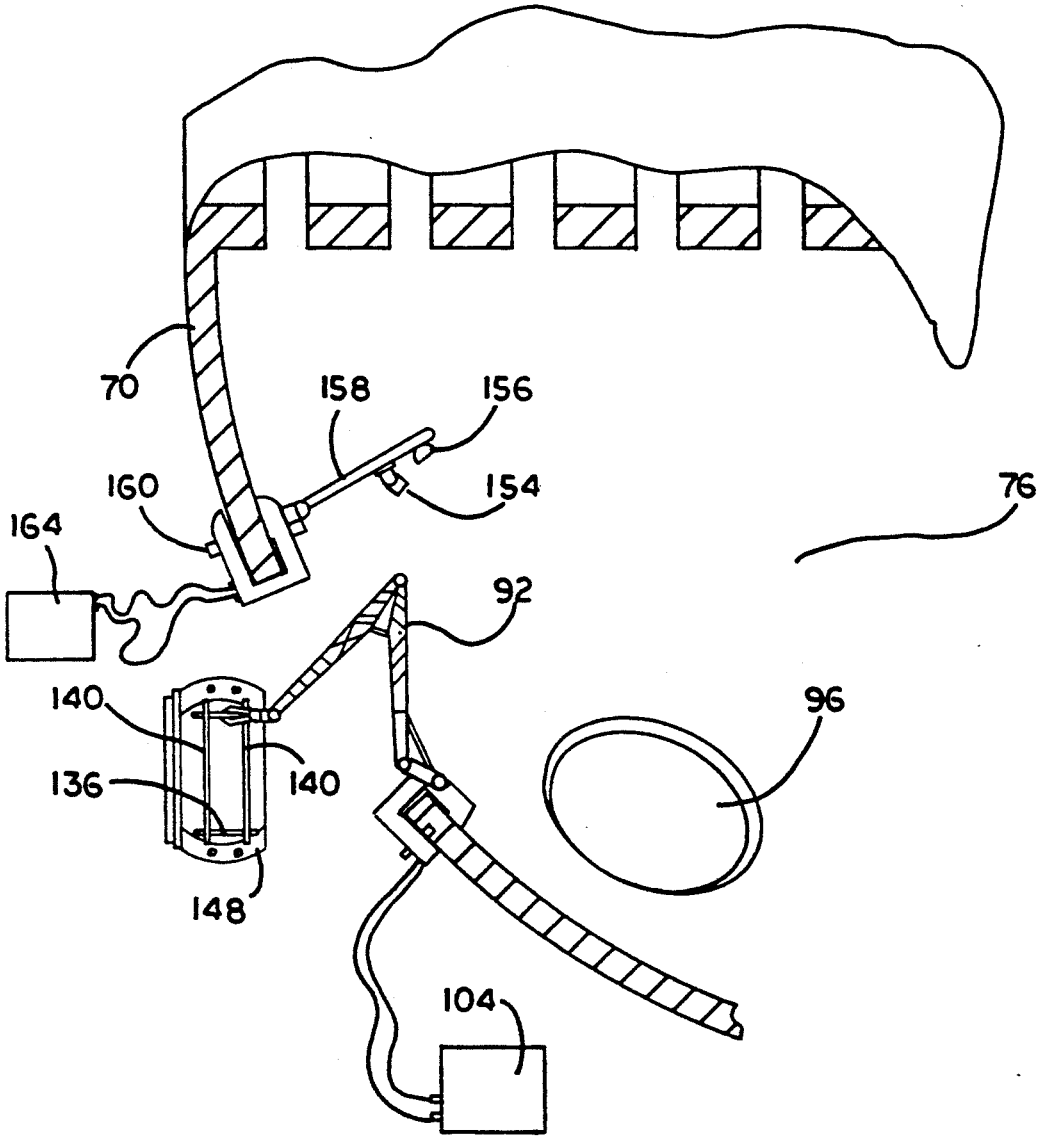
FIG. 5 is a schematic view of the system handling a nozzle dam for installation in the enclosure of FIG. 2.

FIG. 5 shows another preferred embodiment in which manipulator 92 brings a folded nozzle dam assembly 148 into enclosure 76 for installation in nozzle 96, while it is monitored by remote controlled camera 154 and light 156 mounted on remotely adjustable pod 158. Pod 158, is fastened on wall 70 by bolt 160 after it is brought in to the enclosure and positioned on the wall by manipulator 92. The pod, light, and camera, which are operated by control unit 164 via connectors 170 provide data for the operator to direct the system with precision to perform its task.

When the job is done, the manipulator may be used to remove pod 158 from the enclosure, and reinstall the hoist so that the hoist may be used to remove the manipulator from the enclosure.

Figure 6:
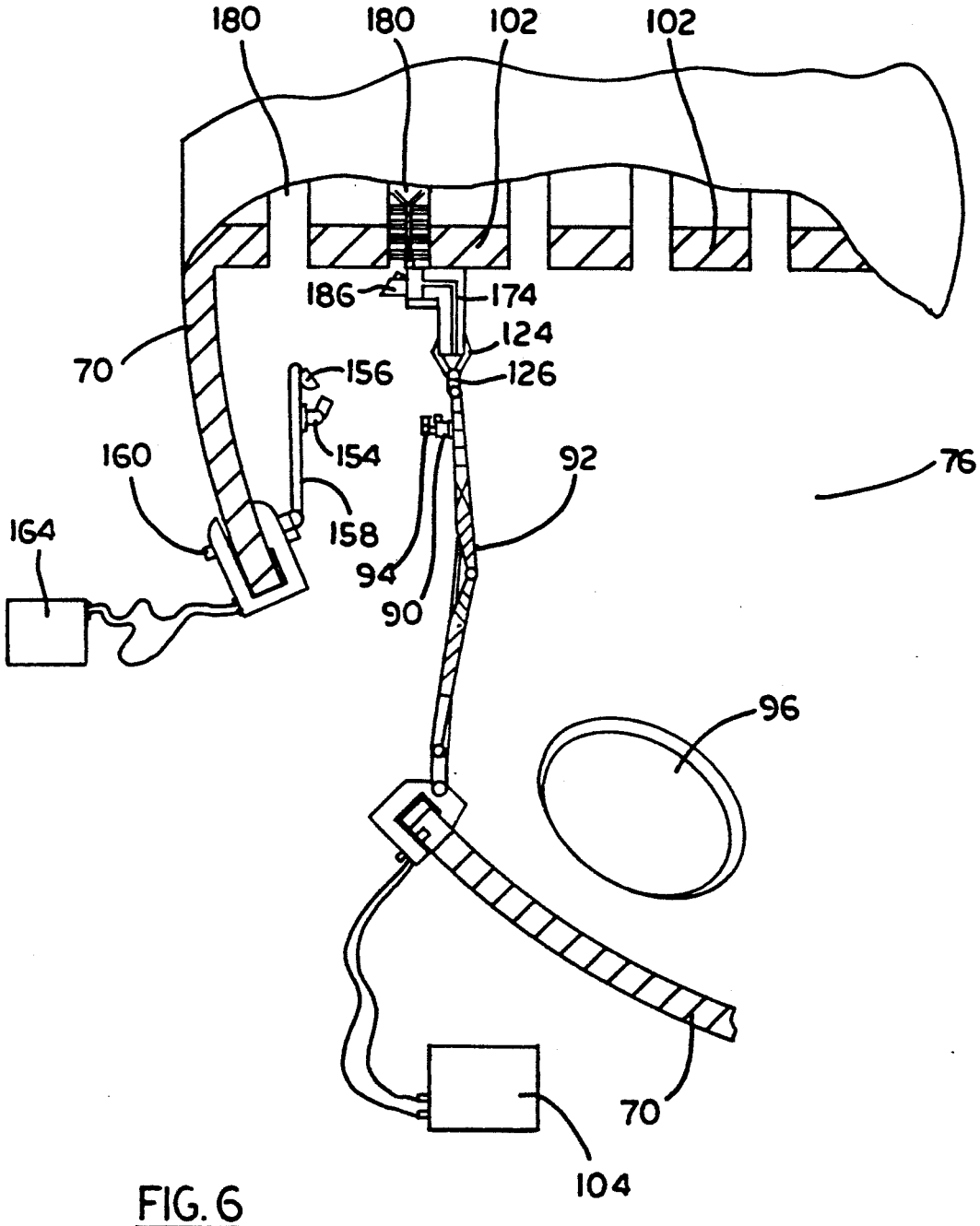
FIG. 6 is a schematic view of the system performing work in the enclosure on a reactor water tube.

FIG. 6 shows articulate manipulator 92 working in enclosure 76 on reactor tube 180 of tube sheet 102. Jaw assembly 124 of tool operator 126 holds electric brush 174 in position for the cleaning operation. Manipulator 92 is guided with the aid of remote controlled camera 90 and remote controlled light 94. Positioning camera 186 aids in precise alignment of the brush for proper cleaning. This is one of the many kinds of work which the system of this invention may perform. They include decontamination, welding, tubing, plugging, eddy current testing, inspections, and measurements.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. In an enclosure comprising a wall and an opening formed in said wall for access to said enclosure, an apparatus for performing work in said enclosure without need for an operator in said enclosure, said apparatus comprising:

means hoisting for bringing articulate manipulator means into said enclosure, said means for hoisting comprising a first mounting base and a lifting portion, said first mounting base being attached to said wall at said opening, with said lifting portion in said enclosure, articulate manipulator means comprising a second mounting base and a tool operator portion, said second mounting base being attached to said wall at said opening, with said tool operator portion in said enclosure.

2. The apparatus for performing work in said enclosure as described in claim 1, further comprising:

said means for hoisting being articulate.

3. The apparatus for performing work in said enclosure as described in claim 1, further comprising:

the attachment of said second mounting base to said wall comprising attachment means outside said enclosure, said manipulator means being adapted for reaching through said opening from inside said enclosure when said second mounting base is attached to said enclosure.

4. The apparatus for performing work in said enclosure as described in claim 3, further comprising:

the attachment of said first mounting base to said wall comprising attachment means outside said enclosure.

5. In an enclosure of a heat exchanger, said enclosure comprising a wall, an opening formed in said wall for access to said enclosure, and a nozzle for fluid flow through said wall, an apparatus for installing dam means in said nozzle without need for an operator in said enclosure, said dam means being for resisting flow of said fluid, said apparatus comprising:

means for hoisting for bringing articulate manipulator means into said enclosure, said means for hoisting comprising a first mounting base and a lifting portion, said first mounting base being attached to said wall at said opening, with said lifting portion in said enclosure, articulate manipulator means comprising a second mounting base and a tool operator portion, said second mounting base being attached to said wall at said opening, with said tool operator portion in said enclosure.

6. The apparatus as described in claim 5, further comprising:

the attachment of said second mounting base to said wall comprising a fastener engaged in a bolt hole in a part of the wall that is outside the enclosure, adjacent to said opening, said manipulator means being adapted for reaching through said opening from inside said enclosure when said second mounting base is attached to said enclosure.

7. The apparatus as described in claim 5, further comprising:

dam means, said tool operator portion of said manipulator means being adapted for engaging said dam means for inserting said dam means in said nozzle.

8. The apparatus as described in claim 5, further comprising:

said dam means comprising a dam which falls within the description of a claim of U.S. Pat. No. 4,957,215.

9. In an enclosure of a heat exchanger, said enclosure comprising a wall, an opening formed in said wall for access to said enclosure, and a nozzle for fluid flow through said wall; a method for performing work in said enclosure, said method comprising:

attaching a hoist to the wall at said opening with the lifting portion of said hoist in the enclosure, then using the hoist to bring an articulate manipulator into the enclosure, and attaching the manipulator to the wall at said opening so that a tool operator portion of the manipulator can perform work in the enclosure.

10. In an enclosure of a heat exchanger, said enclosure comprising a wall, an opening formed in said wall for access to said enclosure, and a nozzle for fluid flow through said wall; a method for performing work in said enclosure, said method comprising:

attaching a hoist to the wall at said opening with the lifting portion of said hoist in the enclosure, then using the hoist to bring an articulate manipulator into the enclosure, and attaching the manipulator to the wall at said opening so that a tool operator portion of the manipulator can perform work in the enclosure, said attaching of said hoist to said wall comprising attaching said hoist to the wall outside the enclosure.

11. In an enclosure of a heat exchanger, said enclosure comprising a wall, an opening formed in said wall for access to said enclosure, and a nozzle for fluid flow through said wall; a method for installing dam means in said nozzle for resisting flow of said fluid, said method comprising:

attaching a hoist to the wall at said opening with the lifting portion of said hoist in the enclosure, then using the hoist to draw an articulate manipulator into the enclosure, and attaching the manipulator to the wall at said opening so that a tool operator portion of the manipulator can perform work in the enclosure for installing said dam means in said nozzle.

12. The method for installing dam means in a nozzle as described in claim 11, further comprising:

said attaching of said manipulator to said wall comprising engaging bolt holes in a part of the wall that is outside the enclosure with fasteners that hold said manipulator so that said manipulator can be made to reach through said opening from inside said enclosure.

13. The method for installing dam means in a nozzle as described in claim 12, further comprising:

said attaching of said hoist to said wall comprising engaging bolt holes in a part of the wall that is outside the enclosure with fasteners that hold said hoist.

14. The method for installing dam means in a nozzle as described in claim 11, further comprising:

said work performed by said tool operator portion of said manipulator comprising grasping a portion of said dam means and then setting said dam means in said nozzle.

15. The method for installing dam means in a nozzle as described in claim 14, further comprising:

said grasping of a portion of said dam means comprising grasping a bar on said dam means which traverses one side of said dam means.

16. The method for installing a dam means in a nozzle as described in claim 14, further comprising:

said dam means comprising a dam which falls within the description of a claim of U.S. Pat. No. 4,957,215.

* * * * *

UNITED STATES PATENT AND TRADEMARK OFFICE

CERTIFICATE OF CORRECTION

PATENT NO. : 5,164,151

DATED : Nov. 17, 1992

INVENTOR(S) : Jagdish H. Shah, Cliff Evans, Donald D. Stenabaugh

It is certified that error appears in the above-identified patent and that said Letters Patent is hereby corrected as shown below:

On the title page, item (54): delete "POINT", and replace with --PORT--.

In the Specification title, column 1, line 2, delete "POINT", and replace with --PORT--.

In Claim 1, column 7, line 41, between "means" and "hoisting for bringing", insert --for--.

Signed and Sealed this

Twenty-eighth Day of September, 1993

Bruce Lehman

*Attest:*

BRUCE LEHMAN

*Attesting Officer*

*Commissioner of Patents and Trademarks*